United States Patent [19]

Zamboni

[11] Patent Number: 4,705,320

[45] Date of Patent: Nov. 10, 1987

[54] ICE RESURFACING MACHINE BLADE HOLDER

[75] Inventor: Richard F. Zamboni, Huntington Beach, Calif.

[73] Assignee: Frank J. Zamboni & Co. Inc., Paramount, Calif.

[21] Appl. No.: 872,406

[22] Filed: Jun. 10, 1986

[51] Int. Cl.[4] ..... E02B 15/02; E01H 5/06

[52] U.S. Cl. ..... 299/24; 30/170; 30/329; 299/93

[58] Field of Search ..... 299/24, 36, 93; 30/170, 30/169, 329; 37/219

[56] References Cited

U.S. PATENT DOCUMENTS

| | | | |
|---|---|---|---|
| 2,763,939 | 9/1956 | Zamboni | 299/24 X |
| 3,622,205 | 11/1971 | Zomboni | 299/24 |
| 3,917,350 | 11/1975 | Bricher | 299/24 |

*Primary Examiner*—Stephen J. Novosad
*Assistant Examiner*—David J. Bagnell
*Attorney, Agent, or Firm*—Herb Boswell

[57] ABSTRACT

A blade holder for holding a disposable ice shaving blade on an ice resurfacing machine has an attachment member which is attached to an appropriate support member on the ice resurfacing machine. The attachment member has an elongated "V" shaped groove which extends across the transverse width of the attachment member. A triangular shaped retaining member mates against a surface in the ∓V" shaped groove on the attachment member. A surface on the attachment member and a wall on the retaining member which are spaced apart from each other in a parallel relationship when the retaining member mates with the attachment member, form a cavity for excepting and retaining a disposable ice shaving blade. The retaining member is connected to the attachment member utilizing a plurality of attaching elements such as appropriate bolts or the like. These attaching elements are independent from the structure which is utilized to attach the attachment member to the appropriate support member on the ice resurfacing machine.

18 Claims, 8 Drawing Figures

Fig. 1
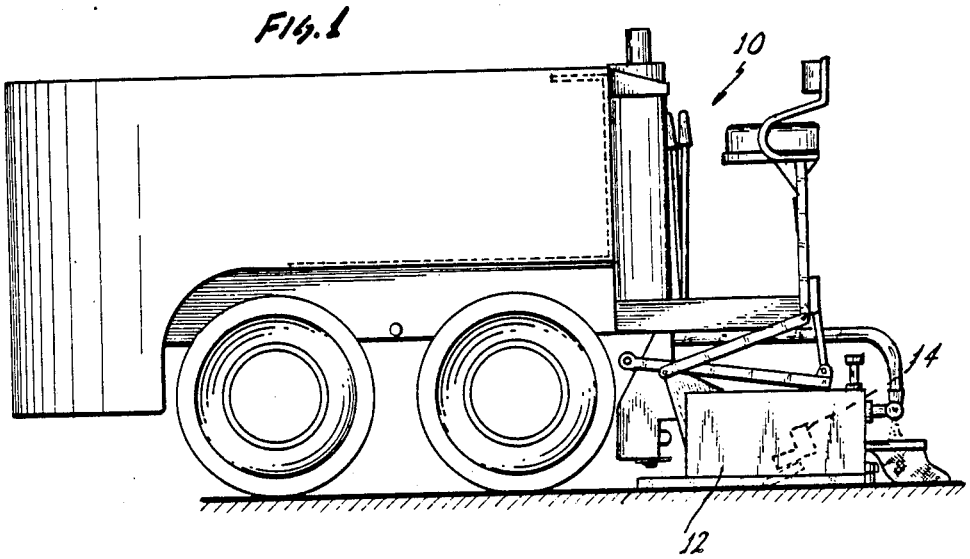
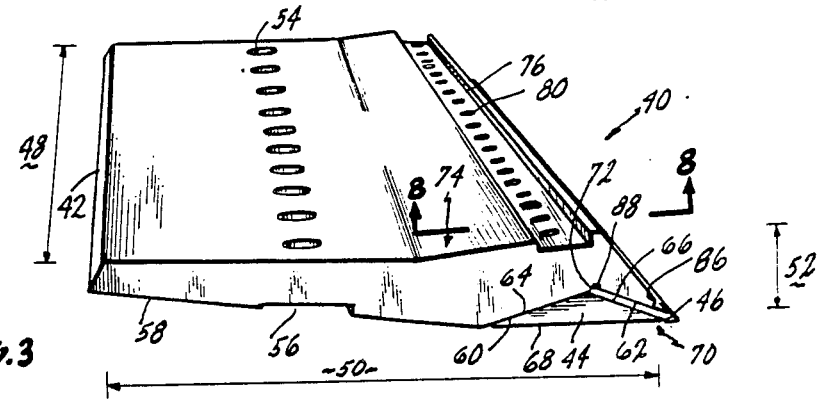
Fig. 3
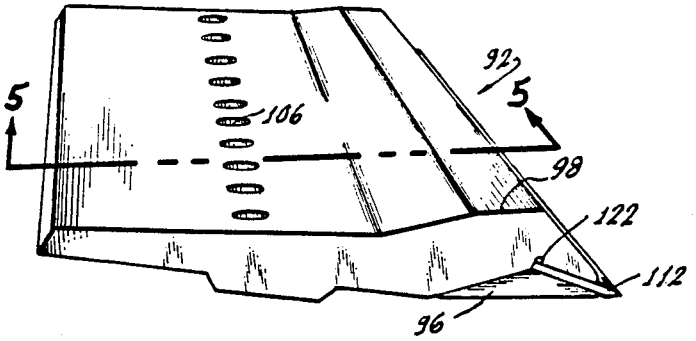
Fig. 4

ICE RESURFACING MACHINE BLADE HOLDER

BACKGROUND OF THE INVENTION

This invention is directed to an improved ice resurfacing machine blade holder for holding disposable blades.

Ice resurfacing machines were developed several decades ago for refurbishing the surface of ice on a skating rink, hockey rink, or other recreational ice surfaces. A modern ice resurfacing machine has the capacity to plane a rough surface of ice with a blade, sweep or vacuum up the ice-shavings planed off the surface of the ice, wash and squeegee the surface, and finally, coat the surface with a light film of water which immediately freezes to form a new ice surface. Basically, the ice resurfacing machine is a self-propelled vehicle having a dump tank for disposing of ice and snow lifted from the surface of the ice, a water tank for supplying fresh water for the surface of the ice, and a sled. Mounted on the sled are the necessary hardware items for shaving the ice, removing the shavings, washing and squeegeeing the ice, and then rewetting the ice.

It is important to condition the ice surface for several reasons. The ice is used for skating in one form or the other. Iceskates have sharp edges which cut into and gouge the surface of the ice caused by the wear and tear of the iceskates moving over the ice. Further, in order to control the energy costs in maintaining an artificial ice surface, it is necessary to maintain proper thickness of the ice.

Since ice is a hard solid, it is abrasive to the blades utilized to shave and plane the ice and it wears down the blade's cutting edge. A dull blade will not properly shave the ice. Use of a dull blade can result in a rough and wavy surface and improper pickup of snow off the ice surface.

Since most ice rinkgs and other ice surfaces are quite large, the ice resurfacing machine must be of a sufficient size so as to be able to traverse over the totality of the surface of the ice in a reasonable amount of time. This requires a certain width to the ice machine such that the width of the resurfacing path of the ice resurfacing machine is sufficiently large in order to resurface the ice in a minimum number of traverses back and forth across the ice surface. Generally, an ice surfacing machine will resurface a width of ice approximately five to seven foot wide. In resurfacing this path width of ice, it is necessary for the ice resurfacing blade to be maintained absolutely fixed across its total width such that the ice will be resurfaced in a smooth plane across the total width of the path of the ice resurfacing machine.

Initially, a single large heavy blade was utilized on ice resurfacing machines. As in explained in the specification of U.S. Pat. No. 3,917,350, when these older monolithic blades were utilized, generally four blades were needed. Two to be sent out to be resharpened, one on the machine for use, and one for replacing as soon as the one of the machine became dull. These older blades weighted in excess of fifty pounds. This large, heavy blade had to be attached and detached from the bottom of the sled portion of the ice resurfacing machine. Generally, the sled portion of the ice resurfacing machine can be raised approximately ten to twelve inches off the surface of the ice. While this allows for a certain amount of working room, it certainly is not a convenient work space. Because the blades were very heavy and had a very sharp edge thereon, and because of the limited space in which to work, for the older monolithic blades at least two men were required for the detaching and remounting of the blade on the ice resurfacing machine.

U.S. Pat. No. 3,917,350 describes the use of disposable light weight blades which are held in a fixture which is attached to the sled portion of an ice resurfacing machine. While several embodiments of holding fixtures are described in this patent, problems have been encountered with each of these.

The disposable blades for use on ice resurfacing machines are lightweight elongated flexible stainless steel blades having a sharpened edge thereon. Since it is absolutely mandatory that these be held in a rigid position beneath the sled of the ice resurfacing machine, mounting them can be equated to the problem of fixing an extremely sharp blade in a six foot wide vice which must be lightweight, perfectly rigid, but at the same time inexpensive and easy to manipulate. As is evident, this is a very exacting and difficult set of criteria to meet.

Problems have been experienced in utilizing prior known blade holders. These problems include the difficulty and consequently the expense in machining the components to the shape necessary for functioning of these holders. Aside from the manufacturing difficulties and cost, in acutal use, the prior blade holders for disposable blades are, on occasion, subject to warpage and misalignment of their component parts. Furthermore, in one commercial embodiment of these blade holders, the same set of bolts are utilized to both attach the blade holder to the ice resurfacing machine and to grip or attach the blade in the blade holder. Thus, in changing the blade, the personnel not only has to content with inserting a very sharp blade into the blade holder, but also have to contend with portions of the blade holder moving with respect to the machine, which complicated the insertion and removal of the blades.

In view of the above, it is evident that there exists a need for new and improved blade holders for use in holding disposable blades on ice resurfacing machines. It is, therefore, a broad object of this invention to provide such new and improved blade holders for ice resurfacing machines. It is a further object of this invention to provide a blade holder for an ice resurfacing machine which allows for quick and convenient replacement of blades without requiring extended expenditure of expensive labor time in doing so. It is a further object to provide a blade holder for an ice resurfacing machine which because of the engineering principles inherent therein is capable of being economically manufactured but is also capable of a long and useful lifetime.

These and other objects as will become evident from the remainder of this specification are achieved in an ice resurfacing machine blade holder which comprises: a blade attachment member sized and shaped so as to have an elongated transverse dimension sufficient to extend across the width of the resurfacing path of the ice resurfacing machine. The blade attachment member has a forward edge and a bottom surface and a top surface all of which extend across the elongated transverse dimension of the attachment member. The blade attachment member includes an inverted "V" shaped groove extending into the bottom surface across the elongated transverse dimension of the attachment member along the forward edge of the attachment member. The "V" shaped groove has an essentially flat planar blade abutting surface and an essentially flat planar retaining element abutting surface with the blade abutting surface positioned towards and intersecting the forward edge of the blade attachment member and with the blade abutting surface located between the forward edge and the retaining element abutting surface. The blade abutting surface and the retaining element abutting surface intersecting each other at an obtuse angle. It further includes a retaining element which is essentially triangular in shape in cross section and has an elongated transverse dimension essentially equal to the elongated transverse dimension of the attachment member. The retaining element has an essentially flat planar blade engaging wall and an essentially flat planar attachment member engaging wall and a bottom wall each of which intersect the others to form the triangular cross sectional shape. The blade engaging wall and the attachment member engaging wall intersecting each other at an obtuse angle equal to or essentially slightly greater than the angle of intersecting of the engagement member blade abutting surface and retaining element abutting surface. The retaining element is positional on the attachment member with the attachment member engaging wall mating with the retaining element abutting surface and the blade abutting surface and the blade engaging wall being spaced apart from one another in an essentially parallel alignment to form a cavity between the attachment member blade abutting surface and the retaining element blade engaging wall. The essentially parallel alignment of blade abutting surface and the blade engaging surface shape the cavity so as to accept a disposal ice resurfacing blade within the cavity. A locking means is included for retaining the retaining element in the mating position against the attachment member whereby the disposal ice resurfacing blade is capable of being temporarily fixely retained in the cavity.

BRIEF DESCRIPTION OF THE DRAWINGS

This invention will be better understood when taken in conjunction with the drawings wherein:

FIG. 1 is a side elevational view of a typical known ice resurfacing machine;

FIG. 3 is an isometric view of a first embodiment of a blade holder of this invention;

FIG. 4 is an isometric view of a further embodiment of a blade holder of this invention;

This invention utilizes certain principles and/or concepts as are set forth in the claims appended hereto. Those skilled in the machine arts will realize that these principles and/or concepts are capable of being utilized in a variety of embodiments which may differ from the exact embodiment utilized for illustrative purposes herein. For this reason this invention is not to be construed as being limited solely to the illustrative embodiments, but should only be construed in view of the claims.

DETAILED DESCRIPTION OF THE INVENTION

Several ice resurfacing machines are known. Certain of these machines are described in U.S. Pat. Nos. 2,763,939; 3,622,205; and 3,917,350. Each of these is assigned or owned by the assignee of this invention, and the entire disclosures of each of these patents is herein incorporated by reference.

A complete understanding of all of the detailed parts of an ice resurfacing machine is not necessary for the understanding of this invention. Reference is made to the above referred to patents for specific understanding of ice resurfacing machines. For the purposes of this invention, it is sufficient to note that an ice resurfacing machine such as the machine 10 of FIG. 1 will include a sled 12 as a component part thereof. Mounted within the interior of the sled is a blade holding assembly 14. For details of such a blade housing assembly, reference is made to the disclosure of U.S. Pat. No. 3,917,350.

Figure 2:
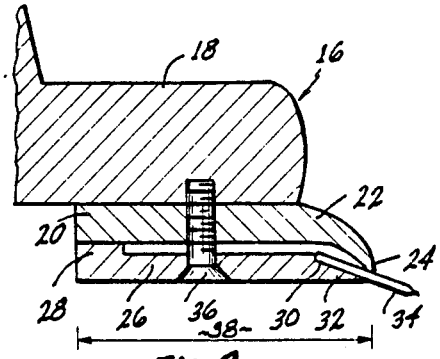
Fig. 2 prior art
FIG. 2 is a side elevational view of a known blade holder and disposable blade as attached to a component mounting part of a typicial ice resurfacing machine as for instance the machine of FIG. 1.

Referring to FIG. 2, a typical prior known blade holder 16 is shown. A support member 18 forms a component part of the blade holding assembly 14 of FIG. 1. Fitting beneath the support member 18 is a clamp bracket 20. The clamp bracket 20 has a forward curving front portion 22 which terminates in a leading edge 24. Located beneath the clamp bracket 20 is a holder 26. The holder 26 has a land 28 on the rear portion thereof and includes a shoulder 30 from which a wedge surface 32 extends. A disposable blade 34 rests on the wedge surface 32 abutting against the shoulder 30. The leading edge 24 of the bracket 20 rests on top of the blade 34. A series of screws 36 clamp the holder 26 to the clamp bracket 20, and, in turn, both of these elements to the support member 18. The blade 34 is pinched between the wedge surface 32 of the holder 36 and the leading edge 24 of the bracket 20.

The land 28 in essence serves as a fulcrum. The screw 36 rotates the holder 26 about the land 28 so as to squeeze the blade into the leading edge 24 to hold it in position. As is evident, the lever arm identified by the numeral 38 between the land 28 and the leading edge 24 is quite long compared to the length of the blade 34 which is held against the wedge surface 32. Further, the back edge of the blade abuts against the shoulder transmits all its force to the holder 26. When force is applied to the cutting edge of the blade 34, a component vector of this force is transmitted to the shoulder 26 exerting a rotational force to the holder 26 tending to rotate it about the land 28. The screw 36 must counteract this rotational force which is amplified by the long lever arm 38.

The shape of the leading edge 24 is difficult to achieve during manufacture of the clamp bracket 20. Furthermore, since the screw 36 not only clamps the blade 34 into the holder 26 and the bracket 20, but also holds these two components to the support member 18, during exchange of a blade 34, the operator must content not only with removing and inserting the blade 34, but with dropping of both the holder 26 and bracket 20 downwardly from the support member 18.

Referring now to FIG. 3 there is shown a first blade holder 40 of the invention. The blade holder 40 has two component parts, an attachment member 42 and a retaining member 44. Further shown in FIG. 3 is a disposable blade 46. As is evident from FIG. 3, the disposable blade 46 is retained in the attachment member 42 by the retaining member 44.

Both the attachment member 42 and the retaining member 44 are formed as unified one piece extrusions. Preferably they are formed of aluminum or some other light weight, strong alloy. As is evident from their shape in FIG. 3, they have a consistent cross sectional shape along the totality of these elements allowing them to be conveniently and economically formed by extrusion.

The width of the attachment member 42 as shown by the line 48 is sufficient such that the attachment member 42 extends across the total resurfacing path width made by the ice resurfacing machine. Typically this width would be of the order of about 90 inches. The length of the attachment member 42 shown by the line 50 in the figure is of the order of about 5 inches and the height, as shown by the line 52, is approximately three-fourths of an inch. As shown in the figures, the dimensions are not to scale. The same is true with respect to the scale of FIG. 4.

The attachment member 42 includes a plurality of attaching holes 54 which are utilized to mount the attachment member 42 to a further blade holding assembly such as the assembly 14 shown in FIG. 1 on the ice resurfacing machine 10. A groove 56 is formed on the bottom surface 58 of the attaching member 42. The groove 56 is cut with side walls which are perpendicular to the bottom of the groove. This allows for the location of square headed nuts in the groove 56 with the side walls of the groove 56 serving to inhibit the rotation of these square nuts. To mount the attaching member 42 to a typical blade holding assembly 14, appropriate bolts (not seperately numbered or shown) would be passed through the blade holding assembly 14 downwardly through the attaching holes 54 and threaded into the square headed nuts (also not seperately numbered or shown) which would be located within the groove 56.

The attachment member 42 has a retaining surface 60 and a blade abutting surface 62 which together form an inverted "V" shaped groove indenting into the bottom surface 58 of the attachment member 42. This accepts the triangular cross sectional shape of a retaining member 44.

The retaining member 44, as is also evident in FIG. 3, is triangular in shape in cross section. Further, it is elongated in width such that it essentially has the same width as the attachment member 42.

The triangular shape of the retaining member 44 is formed by an attaching wall 64 and a blade abutting wall 66 together with a bottom wall 68. When the attaching wall 64 on the retaining member 44 is mated against a retaining surface 60 on the attaching member 42, the retaining member 44 is in a position so as to space a blade abutting surface 62 on the attaching member 42 away from a blade abutting wall 66 on the retaining member 44 such that a blade cavity 70 is formed. An elongated section of the disposable blade 46 is positionable within this blade cavity 70.

Figure 8:
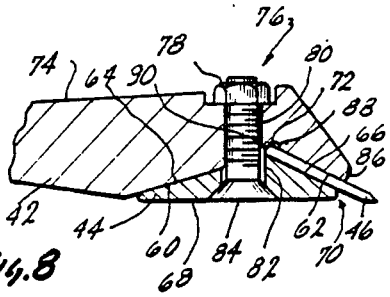
FIG. 8 is a fragmentary side elevational view in partial section about the line 8—8 of FIG. 3.

With reference now to FIG. 8, located on a top surface 74 of the attachment member 42 is a further elongated groove 76 whose sides are perpendicular to its flat bottom. Thus, this groove is also sized and shaped so as to accept square headed nuts 78. A plurality of holes collectively identified by the numeral 80 pass from the bottom of the groove 76 through the attaching member 42 into the retaining surface 60. A like plurality of holes 82 are drilled in the retaining member 44. The holes 82, however, are cut slightly oversized with respect to the holes 80. Further, the openings of the holes 82 in the bottom wall 68 are countersunk.

A plurality of bolts collectively identified by the numeral 84, only one of which is shown in FIG. 8, pass through the holes 82 in the retaining member 44, through the holes 80 and screw into the nuts 78. Since the holes 82 are oversized with respect to the shank size of the bolts 84 and the holes 80, and since the surface of the attaching wall 64 and the retaining surface 60 are at an angle with the respect to the axial axis of the hole 80, as the bolts 84 are tightened to the nuts 78 they cause the retaining member 44 to slide to the right as viewed in FIG. 8 along the surface 60 of the attachment member 42. This brings the blade abutting wall 66 toward the blade abutting surface 62 decreasing the width of the cavity 70. This squeezes against the sides of the blade 46 locking it into the cavity 70 to fixedly hold it in position between the retaining member 44 and the attachment member 42.

As will be discussed in greater detail below, the angle the retaining surface 60 makes with the blade abutting surface 62 is essentially the same as the angle between the attaching wall 64 and the blade abutting wall 66. Because of this, the blade abutting surface 62 is essentially parallel to the blade abutting wall 66. As the retaining member 44 is slid to the right in FIG. 8 upon tightening of the bolts 84 to the nuts 78, this parallel relationship between the surface 42 and the wall 66 is maintained. Because of this, the blade 62 is gripped essentially along the totality of it's surface which is located within the cavity 70 and not simply along an edge as per prior known blade holders. This results in an even force applied to the blade 46, assisting in preventing warpage of the blade 46, and the elimination of uneven stresses to both the attachment member 42 and retaining member 44.

The blade abutting surface 62 extends out of the forward end of the attachment member 42 cutting through this forward end at a forward edge 86 which extends across the complete width of the attachment member 42. The dimension of the blade 46 is chosen such that it is slightly wider (as measured from its cutting edge to its back edge) than that of the cavity 70 such that the cutting edge of the blade 46 extends a slight increment out from the forward edge 86 of the attachment member 42.

A further groove 88 is formed in the attachment member 42 wherein the retaining surface 60 intersects the blade abutting surface 62. The back edge 90 of the groove 88 is essentially perpendicular to the blade abutting surface 62 and serves to receive the back edge 72 of the blade 46. Since this back edge 90 of groove 88 is formed in the attaching member 42, forces transmitted up through the blade from its cutting edge to its back edge 72, are directly transmitted to the attachment member 42 and not to the retaining member 44. The only force transmitted to the retaining member 44 would be a force tending to rotate it away from the retaining surface 60 against the opposing force introduced by the bolts 84 threading into the nuts 78. Since the maximum lever arm of the retaining member 44 can only be as long as its bottom wall 68, this lever arm is much smaller than in prior known devices and, thus, little or no forces are carried by the retaining member 44. Because of this, it can be reduced in size with respect to prior known components which were utilized to retain a blade against a further component.

Because of the shape and construction of the attaching member 42 and retaining member 44, for a blade holder 40 of approximately 80 inches width, the totality of the weight of the holder including the blade will only be on the order of fifteen pounds. This is a substantial reduction in weight compared to other prior known ice resurfacing machine blades.

Figure 5:
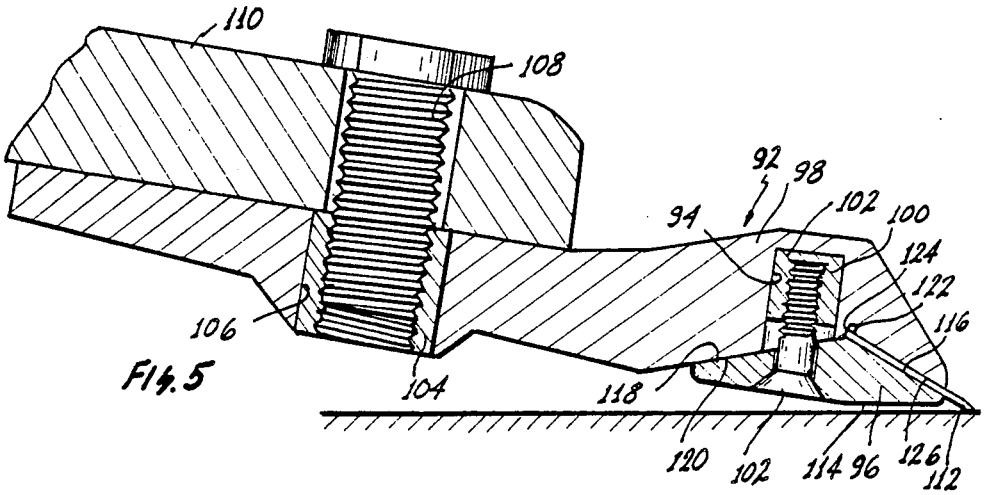
FIG. 5 is a side elevational view in partial section about the line 5—5 of FIG. 4.

Referring now to FIGS. 4 and 5, a further embodiment of the invention is shown. In this embodiment, a blade holder 92 is illustrated. The blade holder 92 is similar in construction to the blade holder 40 with the exception that it does not include the groove 76. Instead of utilizing square nuts 78 on its upper surface, holes 94 equivalent to the holes 80 of the bade holder 40, are drilled only part way into an attaching member 98, and a threaded insert 100 is force-fitted into the attaching member 98. Appropriate bolts 102 can then be utilized to connect a retaining member 96 to the attaching member 98 in the manner described for the embodiment of FIG. 3. Threaded inserts 104 are also force-fitted into holes 106 to receive connecting bolts 108 for attachment of attachment member 98 to a support member 110.

Utilizing the embodiment of FIGS. 4 and 5 for illustration purposes, during cutting or shaving of the ice, preferably the blade 112 is held at an angle of about 32° to the ice surface. Because of this, the angle between the bottom wall 114 and the blade abutting wall 116 of the retaining member 96 is a small acute angle, as for instance at about 24°. The angle between the bottom wall 114 and the attaching wall 118 is also a small acute angle, as for instance about 18°. The angle between the blade abutting wall 116 and the attaching wall 118 is a large obtuse angle, as for instance about 138°. As such, the ratio of the length of the blade abutting wall 116 to the attaching wall 118 to the bottom wall 114 is about 1.5:2:3. These approximate ratios allow for sliding of the retaining member 96 on the attachment member 98 when under a force applied by the bolts 102 to the retaining member 96 so as to squeeze or pinch the blade 112 between the attachment 98 and the retaining member 96.

As per the embodiment of FIG. 3, the embodiment of FIGS. 4 and 5 also include a groove 122 formed in the attachment member 98. The groove 122 has a back wall 124 which is perpendicular to the blade 112 abutting surface 126 such that the force transmitted along the blade directly from its tip to its rear edge is taken up directly by the attaching member 98.

Figure 6:
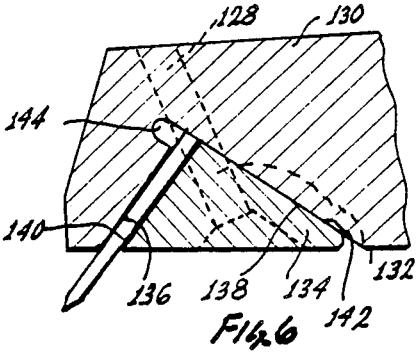
FIG. 6 is a diagrammatical view of certain components of a further embodiment of the invention.

In FIG. 6 a further embodiment is shown. This embodiment differs from the embodiments of FIGS. 3, 4, and 5 in that in this embodiment a hole 128 passing through an attachment member 130 and a corresponding hole 132 passing through a retaining member 134 are positioned so as to go through the intersecting point of a blade abutting surface 136 and a retaining surface 138 on the attachment member 130 and a blade abutting wall 140 and an attaching wall 142 on the retaining member 134. As with the prior embodiments, a groove 144 can be located at the line of intersection of the surfaces 136 and 138.

Figure 7:
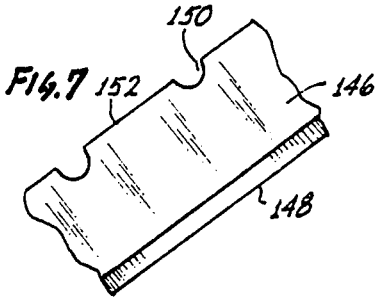
FIG. 7 is a fragmentary isometric view of a blade utilized in the embodiment of FIG. 6.

For use with the embodiment of FIG. 6, a blade as is shown in FIG. 7 would be utilized. The blade 146 shown in FIG. 7 has a cutting edge 148 and includes a plurality of notches 150 located in its rear edge 152. The notches 150 are sized and shaped so as to align with the holes 128 and 132 passing through the attaching member 130 and retaining member 134 of FIG. 6.

In the embodiments of FIGS. 6 and 7, an appropriate bolt (not numbered or shown) passing through the holes 132 and 128 would be located within the notch 150 and would urge the retaining member 134 against the blade 146 to hold it against the attachment member 130.

Preferably in each of the embodiments shown, the angle between the blade abutting surface and the retaining surface on each of the attachment members would be the same as the angle between the blade abutting wall and attachng wall on each of the retaining members shown. This would assure that when the retaining wall was mated against the abutting wall, that the blade abutting surface would be parallel to the blade abutting wall. However, to account for manufacturing, tolerances in machining the extrusion fixture, the angle on the retaining member between the blade abutting wall and the attaching wall, if not made exactly the same as the angle between the blade abutting surface and the retaining surface on the attaching member, would be made slightly larger than this angle. When so formed, the blade abutting surface and the blade abutting wall would not be perfectly parallel to one another but they would be slightly closer together near the forward edge of the attachment member. Because both abuttment member and the retaining member are thinner near the forward edge, any slight flexure or cold flow of the casting material near this thin edge should tend to reshape these components back towards a parallel fit between the blade abutting surface and the blade abutting wall and the side surfaces of the blade.

I claim:

1. An ice resurfacing machine blade holder which comprises:

a blade attachment member, said blade attachment member sized and shaped so as to have an elongated transverse dimension sufficient to extend across the width of the resurfacing path of said ice resurfacing machine, said blade attachment member having a forward edge and a bottom surface and a top surface all of which extend across said elongated transverse dimension of said attachment member;

said blade attachment member including an inverted "V" shaped groove extending into said bottom surface across said elongated transverse dimension of said attachment member along said forward edge of said attachment member, said "V" shaped groove having an essentially flat planar blade abutting surface and an essentially flat planar retaining element abutting surface, said blade abutting surface positioned towards and intersecting said forward edge of said blade attachment member with said blade abutting surface located between said forward edge and said retaining element abutting surface, said blade abutting surface and said retaining element abutting surface intersecting each other at an obtuse angle;

a retaining element, said retaining element being essentially triangular in shape in cross section and having an elongated transverse dimension essentially equal to said elongated transverse dimension of said attachment member;

said retaining element having an essentially flat planar blade engaging wall and an essentially flat planar attachment member engaging wall and a bottom wall each of which intersects the others to form said triangular cross sectional shape, said blade engaging wall and said attachment member engaging wall intersecting each other at an obtuse angle equal to or essentially slightly greater than the angle of intersecting of said engagement member blade abutting surface and retaining element abutting surface;

said retaining element positionable on said attachment member with said attachment member engaging wall mating with said retaining element abutting surface and said blade abutting surface and said blade engaging wall being spaced apart from one another in an essentially parallel alignment to form a cavity between said attachment member blade abutting surface and said retaining element blade engaging wall, said essentially parallel alignment of blade abutting surface and said blade engaging surface shaping said cavity so as to accept a disposable ice resurfacing blade within said cavity;

locking means for retaining said retaining element in said mating position against said attachment member whereby said disposable ice resurfacing blade is capable of being temporarily fixedly retained in said cavity.

2. The blade holder of claim 1 wherein:

said attachment member is a one piece extruded member.

3. The blade holder of claim 1 wherein:

said retaining element is a one piece extruded element.

4. The blade holder of claim 1 wherein:

said attachment member is a one piece extruded member and said retaining element is a one piece extruded element.

5. The blade holder of claim 1 wherein:

said attachment member includes a further elongated groove, said further elongated groove extending into said attachment member towards said top surface of said attachment member across said elongated transverse dimension of said attachment member at the line of intersection of said planar blade abutting surface and said planar retaining element abutting surface.

6. The blade holder of claim 5 wherein:

said further groove is shaped in cross section so as to include a retaining wall which is essentially perpendicular to said planar blade abutting surface, said further groove retaining wall intersecting said retaining element abutting surface.

7. The blade holder of claim 1 wherein:

said locking means includes a plurality of connecting means for temporarily connecting said retaining element to said attachment member, said connecting means positioned in a spaced array along the length of said elongated transverse dimension of said attachment member.

8. The blade holder of claim 7 wherein:

each of said connecting means includes at least a bolt and a first opening in said retaining element extending between said bottom wall and at least one of said blade engaging wall and said attachment member engaging wall, each of said connecting means further including thread means for connecting to said bolt, said thread means operatively associated with said attachment member in a location on said attachment member to align with said first opening in said retaining element when said retaining element is mated with said attachment member.

9. The blade holder of claim 8 wherein:

said thread means comprises a second opening in said attachment member, said second opening including a set of threads located in said opening and extending through at least said retaining element abutting surface.

10. The blade holder of claim 9 wherein:

said first opening in said retaining element extends through said bottom wall and through said intersection of said blade engaging wall and said attachment member engaging wall;

said second opening and said set of threads extends through the intersection of said retaining element abutting surface and said blade abutting surface so as to align with said first opening in said retaining element when said retaining element is mated with said attachment member.

11. The blade holder of claim 9 wherein:

said first opening is of a larger diameter than the diameter of said second opening.

12. The blade holder of claim 10 wherein:

said attachment member includes a further elongated groove, said further elongated groove extending into said attachment member towards said top surface of said attachment member across said elongated transverse dimension of said attachment member at the line of intersection of said planar blade abutting surface and said planar retaining element abutting surface, said further groove being shaped in cross section so as to include a retaining wall which is essentially perpendicular to said planar blade abutting surface, said further groove retaining wall intersection said retaining element abutting surface;

said second opening extends through said groove.

13. The blade holder of claim 1 wherein:

said attachment member further includes a plurality of attachment member attaching holes extending in a spaced array across the transverse dimension of said attachment member through said attachment member between said bottom surface and said top surface in positions with respect to said front edge so as to be positioned behind said retaining element abutting surface such that said retaining element abutting surface is located between said front edge and said attaching holes and further including at least a further portion of said attachment member being located between said retaining element aubtting surface and said attaching holes such that said attaching holes do not intersect said retaining element abutting surface.

14. The blade holder of claim 13 wherein:

each of said attaching holes includes a set of threads located therein.

15. In combination with an ice resurfacing machine of the type having a blade and a blade support element for mounting said blade to said machine, the improvement which comprises:

an elongated thin disposable ice resurfacing blade;

a blade attachment member, said blade attachment member sized and shaped so as to have an elongated transverse dimension sufficient to extend across the width of the resurfacing path of said ice resurfacing machine, said blade attachment member having a forward edge and a bottom surface and a top surface all of which extend across said elongated transverse dimension of said attachment member;

siad blade attachment member including an inverted "V" shaped groove extending into said bottom surface across said elongated transverse dimension of said attachment member along said forward edge of said attachment member, said "V" shaped groove having an essentially flat planar blade abutting surface and an essentially flat planar retaining element abutting surface, said blade abutting surface positioned towards and intersecting said forward edge of said blade attachment member with said blade abutting surface located between said forward edge and said retaining element abutting surface, said blade abutting surface and said retaining element abutting surface intersecting each other at an obtuse angle;

a retaining element, said retaining element being essentially triangular in shape in cross section and having an elongated transverse dimension essentially equal to said elongated transverse dimension of said attachment member;

said retaining element having an essentially flat planar blade engaging wall and an essentially flat planar attachment member engaging wall and a bottom wall each of which intersect the others to form said triangular cross sectional shape, said blade engaging wall and said attachment member engaging wall intersecting each other at an obtuse angle equal to or essentially slightly greater than the angle of intersecting of said engagement member blade abutting surface and retaining element abutting surface;

said retaining element positionable on said attachment member with said attachment member engaging wall mating with said retaining element abutting surface and said blade abutting surface and said blade engaging wall being spaced apart from on another in an essentially parallel alignment to form a cavity between said attachment member blade abutting surface and said retaining element blade engaging wall, said essentially parallel alignment of blade abutting surface and said blade engaging surface shaping said cavity so as to accept said disposable ice resurfacing blade within said cavity;

locking means for retaining said retaining element in said mating position against said attachment member whereby said disposable ice resurfacing blade is capable of being temporarily fixedly retained in said cavity to hold said blade on said ice resurfacing machine.

16. The combination of claim 15 including:

said locking means includes a plurality of connecting means for temporarily connecting said retaining element to said attachment member, said connecting means positioned in a spaced array along the length of said elongated dimension of said;

each of said connecting means includes at least a bolt and a first opening in said retaining element extending between said bottom wall and at least one of said blade engaging wall and said attachment member engaging wall, each of said connecting means further including thread means for connecting to said bolt, said thread means operatively associated with said attachment member in a location on said attachment member to align with said first opening in said retaining element when said retaining element is mated with said attachment member;

said thread means comprises a second opening having a set of threads located in said second opening and extending through at least said retaining element abutting surface;

said first opening in said retaining element extends throughs aid bottom wall and through said intersection of said blade engaging wall and said attachment member engaging wall;

said second opening extends through the intersection of said retaining element abutting surface and said blade abutting surface so as to align with said opening in said retaining element when said retaining element is mated with said attachment member.

17. The combination of claim 16 further including:

said blade having a front edge having a cutting surface thereon and a back edge positioned opposite said front edge;

said back edge including a plurality of notches located in a spaced array along said back edge of said blade, said array of notches in said blade being positioned so as to align with said connecting means whereby when said blade is located in said cavity said bolts can extend upwardly through said openings in said retaining member through said notches and into said threads in said attachment member.

18. The combination of claim 16 wherein:

said first opening is of a diameter which is larger than the diameter of said second opening.

* * * * *

UNITED STATES PATENT AND TRADEMARK OFFICE

CERTIFICATE OF CORRECTION

PATENT NO. : 4,705,320

DATED : NOVEMBER 10, 1987

INVENTOR(S) : RICHARD F. ZAMBONI

It is certified that error appears in the above-identified patent and that said Letters Patent is hereby corrected as shown below:

Column 1, line 7, insert the phrase ". Resurfacing of the ice removes the rough surface of the ice".

Column 1, line 38, "rinkgs" should be --rinks--.

Column 1, line 60, "weighted" should be --weighed--.

Column 2, line 26, "acutal" should be --actual--.

Column 2, line 33, "content" should be --contend--.

Column 3, line 36, "disposal" should be --disposable--.

Column 3, line 40, "disposal" should be --disposable--.

Column 3, line 41, "fixely" should be --fixedly--.

Column 3, line 52, "typicial" should be --typical--.

Column 4, line 47, "holder 36" should be --holder 26--.

UNITED STATES PATENT AND TRADEMARK OFFICE

CERTIFICATE OF CORRECTION

PATENT NO. : 4,705,320

DATED : NOVEMBER 10, 1987

INVENTOR(S) : RICHARD F. ZAMBONI

It is certified that error appears in the above-identified patent and that said Letters Patent is hereby corrected as shown below:

Column 4, line 59, "shoulder 26" should be --holder 26--.

Column 5, lines 1 and 2, "content" should be --contend--.

Column 7, line 24, "bade" should be --blade--.

Column 8, line 20, "attachng" should be --attaching--.

Column 10, line 42, "intersection" should be --intersecting--.

Column 10, lines 57 and 58, "aubtting" should be --abutting--.

Column 11, line 10, "siad" should be --said--.

Column 12, line 12, "dimension of said" should be --dimension of said blade--.

Column 12, line 29, "aid" should be --said--.

In the Abstract, line 8, "+V" shaped" should be "V".

Signed and Sealed this

Seventeenth Day of January, 1989

*Attest:*

*Attesting Officer*

DONALD J. QUIGG

*Commissioner of Patents and Trademarks*